US007789379B2

(12) United States Patent
Livingston, Jr. et al.

(10) Patent No.: US 7,789,379 B2
(45) Date of Patent: Sep. 7, 2010

(54) SOLID SURFACE CLAMP

(75) Inventors: Larry Leigh Livingston, Jr., Pilot Hill, CA (US); Derek Carlton Westlund, Placerville, CA (US)

(73) Assignee: Omni Cubed Design, LLC, Placerville, CA (US)

( * ) Notice: Subject to any disclaimer, the term of this patent is extended or adjusted under 35 U.S.C. 154(b) by 113 days.

(21) Appl. No.: 11/013,021

(22) Filed: Dec. 15, 2004

(65) Prior Publication Data

US 2005/0133979 A1 Jun. 23, 2005

Related U.S. Application Data

(60) Provisional application No. 60/530,431, filed on Dec. 17, 2003.

(51) Int. Cl.
*B25B 5/10* (2006.01)

(52) U.S. Cl. ..... 269/249; 269/271; 269/45; 269/258

(58) Field of Classification Search ..... 269/249, 269/243, 282, 283, 248, 43, 45, 71, 258, 269/271
See application file for complete search history.

(56) References Cited

U.S. PATENT DOCUMENTS 266,877 A * 10/1882 Reno ..... 169/7
546,903 A * 9/1895 Ryan ..... 269/243
711,948 A * 10/1902 Dodge ..... 269/208
1,288,112 A * 12/1918 Minnis ..... 269/98
1,470,706 A * 10/1923 Day ..... 269/215
1,477,219 A * 12/1923 Halvorsen ..... 269/246
1,749,491 A * 3/1930 Kokay ..... 269/215
3,055,654 A * 9/1962 Harrison et al. ..... 269/241
6,595,508 B2 * 7/2003 Duncan ..... 269/242
2005/0133979 A1 * 6/2005 Livingston et al. ..... 269/249

* cited by examiner

*Primary Examiner*—Lee D Wilson
(74) *Attorney, Agent, or Firm*—Manuel de la Cerra

(57) ABSTRACT

A solid surface clamp is provided. The solid surface clamp has a top jaw and a bottom jaw. A connecting rod is attached to one of the jaws, and slideably extends through the other jaw. Alignment surfaces may be incorporated into the jaws to assist in accurately positioning the material to be laminated. A compression device is connected to the portion of the connecting rod that extends through the jaw. A shroud shields the compression device, thereby protecting the compression device from contamination by the laminating adhesive. An elongated stiffening member may be used to apply the clamping force over a longer surface, allowing for greater spacing between clamps and extended regions of even clamping pressure.

12 Claims, 7 Drawing Sheets

SOLID SURFACE CLAMP

RELATED APPLICATIONS

This application claims priority to U.S. patent application No. 60/530,431, entitled "Solid Surface Laminating Clamp System, which was filed on Dec. 17, 2003 and is incorporated herein by reference.

FIELD OF THE INVENTION

This invention relates to mechanical clamping devices. More particularly, the invention relates to clamps which may be used in the process of laminating or adhering materials together in the solid surface industry.

BACKGROUND

The demand for solid surface countertops such as granite, marble, engineered stone, and Corian® have steadily risen over the past decade. As the demand for solid surface countertops, vanities, tub-decks, fire place mantles and hearths continue to grow, the more imperative it is for solid surface fabrication companies to do the work faster, without sacrificing quality, in order to meet demand. In working with solid surfaces, it is often desirable to laminate two or more pieces of material together, especially at the visible edges of countertops. By laminating pieces together, it is possible to make the finished countertop appear thicker, and to provide a more substantial edge for the application of more elegant edge treatments. For example, much of the granite on the west coast comes in slabs that are only about 20 mm thick. In order to make the countertop appear thicker, a narrow strip of the slab is laminated to all visible edges, making the slab appear to be twice as thick. Also, the edge is now more substantial, allowing more complex and interesting edge treatments to be ground or cut into the edge. For example, when a 20 mm strip is laminated to a 20 mm thick countertop, an elegant full bullnose may be ground onto the edge. The process of laminating material is a regular and necessary task for most solid surface fabrication companies. Unfortunately, because this industry is still relatively young, the technology and tools used to laminate these materials are quite crude.

Solid surface material is often sold in slabs, which, in the case of granite, may be up to 9 feet by 6 feet in size, and in some cases, even larger. Solid surfaces may also be sold in tile form. These tiles are often available in standard sizes, such as 12"×12", 16"×16", or 18"×18". It will be appreciated that solid material may be available in a variety of sizes, and may represent either a natural or man-made material.

Standard c-clamps are the most common tool employed by solid surface fabricators for joining two materials. There are many problems associated with using c-clamps, including the time it takes to use them, recurring replacement costs, poor lamination quality, and increased risk of repetitive motion injuries. When laminating using conventional tools, an adhering agent is applied between two pieces of material, the pieces are manually aligned, and then c-clamps are used to press the pieces together while the adhering agent cures. To achieve an even clamping pressure, the c-clamps must be spaced evenly and close together (as little as 3"), depending on the size of the c-clamp. Each c-clamp must be tightened to approximately the same torque as all the others. Even small differences in compression may result in a poor adhesion, or in one or both material pieces breaking. Additional fabricating operations are performed on the solid surfaces after they are joined and the adhering agent has cured such as machining, cutting, grinding, sanding, and polishing. Noticeable gaps between the two materials will appear after these other fabricating operations if even clamping pressure was not achieved during the joining process. Noticeable gaps are unacceptable and the completed work may be rejected, resulting in expensive material and labor loss due to rework and replacement efforts.

The use of conventional c-clamps for laminating has several undesirable effects. For example, it takes a long time to apply all the c-clamps and often requires more than one employee to tighten all the c-clamps before the adhering agent begins to cure. Also, as the c-clamps are tightened, the glue, epoxy, or other adhering agent may be squeezed from between the pieces. This adhering agent is, by nature, sticky and difficult to work with, and permanently hardens during the curing process. In this way, the screw threads on the c-clamps get contaminated with the adhering agent, rendering them inoperable and thus requiring recurring replacement costs. In addition, due to the highly concentrated pressure point of c-clamps, one or both pieces of material are often broken. Rejections due to uneven clamping pressure are also common and are often caused by user fatigue (c-clamps not tight enough or not evenly tightened) or the c-clamps being spaced too far apart. Finally, there is also an increased risk of repetitive motion injuries due to the high number of c-clamps and the force required to tighten each c-clamp manually by hand.

SUMMARY

Briefly, a solid surface clamp is provided. The solid surface clamp has a top jaw and a bottom jaw. A connecting rod is attached to one of the jaws, and slideably extends through the other jaw. An elongated stiffening member may attach to one of the jaws, which applies a clamping force over a longer surface, allowing for greater spacing between clamps and extended regions of even clamping pressure. Alignment surfaces may cooperate with one or both of the jaws to assist in accurately positioning the material to be laminated. A compression device is connected to the portion of the connecting rod that extends through the jaw. A shroud may shield the compression device, thereby protecting the compression device from contamination by the laminating adhesive.

In one example of the solid surface clamp, the clamp has a top jaw and a bottom jaw. A bolt is attached to the bottom jaw, and the threaded portion of the bolt extends through the top jaw. A nut is threaded on to the bolt, which when tightened, draws the jaws together. A shroud covers the nut and the bolt threads that extend through the top jaw, thereby protecting the nut and the bolt threads from contamination. The nut may be integrally formed with the shroud. The nut may be coupled to a handle or knob for manual tightening, or may have a coupling to a drill or other power tool. An elongated stiffening member may be attached to the top jaw, enabling the clamping force to be distributed over extended regions of the material. Both the top and bottom jaw each have alignment surfaces, enabling the efficient alignment of the materials being laminated, and also proper clamp placement relative to the materials.

Advantageously, the solid surface clamp protects the compression device, which may be in the form of a cooperating threaded bolt and nut, from contamination by the laminating adhesive. Also, the alignment surfaces assist in the alignment of the material to be laminated, in addition to ensuring proper clamp placement, which overall makes the lamination process more efficient. Further, when the elongated stiffening member is used, the clamping force may be more evenly distributed over extended regions, and also enables the use of fewer clamps as compared to the conventional c-clamp.

BRIEF DESCRIPTION OF THE DRAWINGS

The invention can be better understood with reference to the following figures. The components within the figures are not necessarily to scale, emphasis instead being placed upon clearly illustrating the principles of the invention. It will also be understood that certain components and details may not appear in the figures to assist in more clearly describing the invention.

DETAILED DESCRIPTION

Figure 1:
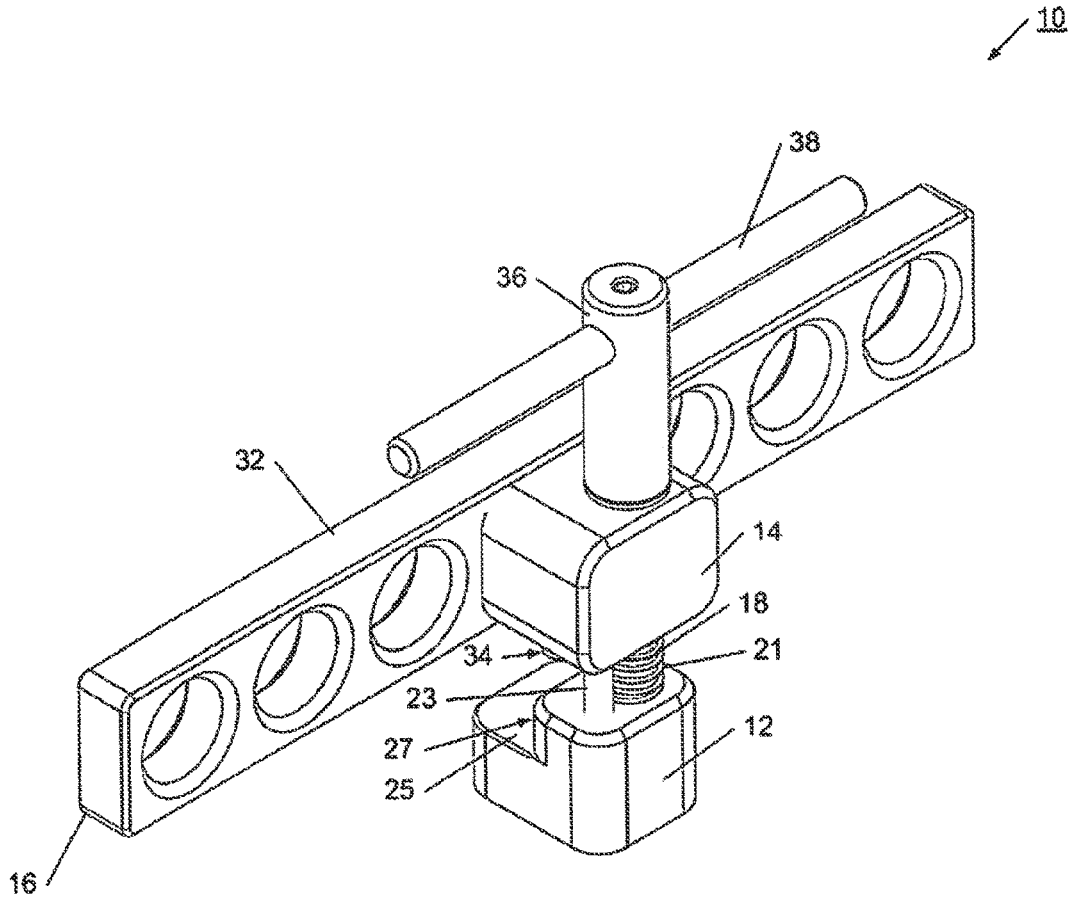
FIG. 1 is a rear perspective view of a solid surface clamp in accordance with the present invention.

Referring now to FIG. 1, a solid surface clamp 10 is illustrated. Solid surface clamp 10 is advantageously used to assist in laminating solid surface materials together. For example, solid surface clamp 10 may be used to laminate granite, marble, Corian®, engineered stone, and other solid surfaces. When laminating, typically two pieces of material are adhered together. Often, the bottom piece will be a larger slab of material, with its finished surface resting on a work bench. The top piece often is a relatively narrow strip of material. For example, when edging a granite slab, the granite slab is used as the bottom piece, while a 1½ inch wide strip of granite is used as the top piece. When the laminating adhesive agent has cured, the slab is turned over so that the strip becomes a lower edge to a countertop. The solid surface may be in the form of slabs, sheets, or tiles. It will be appreciated that other solid surface materials may be used with solid surface clamp 10. Solid surface clamp 10 may be manufactured or milled from aluminum stock, or may be formed using other rigid materials.

Solid surface clamp 10 has a bottom jaw 12 and a top jaw 14. A connecting rod in the form of bolt 18 connects the bottom jaw 12 to the top jaw 14. More particularly, the bolt 18 is fixedly attached to the bottom jaw 12 and is slideably received through the top jaw 14. The threaded portion of bolt 18 extends through the top jaw 14 so that a threaded nut in hub 36 couples to the threaded portion of the bolt 18. The hub 36 has sufficient space for receiving the threaded portion, and the nut may be integrally formed. In this way, the hub 36 acts as a shroud to protect the bolt threads and the nut. For example, contamination from adhesives or other substances may be avoided. It will be appreciated that some applications may not require the use of a shroud.

A spring 21 surrounds the bolt and is positioned between the top jaw 14 and the bottom jaw 12. The spring 21 thereby causes the jaws to separate and press the top jaw 14 against the hub 36. A jaw alignment pin 23 is also secured into the bottom jaw 12, and extends into the top jaw 14. The jaw alignment pin 23 thereby assists in properly aligning the jaws. Other structures may be used for aligning the jaws. For example, the jaws may be arranged to travel in a track member. In another example, the jaw alignment pin extends through one of the jaws and cooperates with the connecting rod in applying a force.

The bottom jaw 12 receives one of the pieces to be laminated on to surface 25. Further, bottom jaw 12 has an alignment surface 27 which is arranged parallel to the properly positioned material. In this way, the material rests on surface 25 and may be properly aligned against alignment surface 27. An elongated stiffening member 32 is attached to top jaw 14. The elongated stiffening member enables the clamping force from the solid surface clamp 10 to be distributed across extended regions of the laminated material. When under compression, the solid surface clamp 10 distributes its force across the bottom surface 16 of the elongated stiffening member 32. The top jaw 14 also has an alignment surface 34. The alignment surface 34 assists in efficiently and accurately positioning the pieces of material prior to the application of full clamping force. A clamping force may be applied using a handle 38, which extends through hub 36. In another example of applying a clamping force, the hub 36 may be in a hex shape or include some other integral shape, thereby enabling the coupling of a power tool with a hex driver or some other coupling method to rotate the hub 36. As the hub 36 is rotated, the nut within the hub 36 draws down on threads of bolt 18, thereby compressing the jaws together. In this way, a compressive force is created between bottom surface 25 and the surface 16 on the elongated stiffening member.

Advantageously, the solid surface clamp 10 protects the threads and bolt from contamination. Further, the solid surface clamp 10 distributes the clamping force over a longer edge, thereby more evenly distributing the force and permitting the use of fewer clamps as compared to conventional clamping tools. In this way, a set of solid surface clamps may be spaced apart and still provide sufficient and even clamping force. Also, the alignment surfaces on the top and bottom jaws enable the efficient alignment of the material to be clamped. By assisting the alignment, and by enabling the use of fewer clamps, the laminating process is made more efficient using the solid surface clamp 10.

Figure 2:
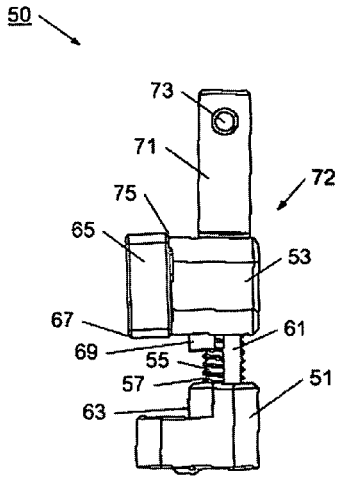
FIG. 2 is a side view of a solid surface clamp in accordance with the present invention.

Referring now to FIG. 2, a side view of a solid surface clamp 50 is illustrated. Solid surface clamp 50 has a top jaw 53 and a bottom jaw 51. A bolt 55 is fixedly attached to bottom jaw 51 and is slideably received through top jaw 53. Threads extend through the top jaw 53 and into hub 71. Hub 71 has an integral nut which threadably couples to the thread portion of the bolt. The thread portion of the bolt and the nut from the hub cooperate to provide a compression device 72. It will be appreciated that other compression devices may be used. For example, a ratchet mechanism, a cam-action clamp, or toggle clamp may be used to draw the jaws together. In another example, the compression device may include rams or other hydraulic or pneumatic devices. The hub 71 acts as a shroud and surrounds the compression device, shielding it from contamination. It will be understood that the shroud may take other forms. For example, the shroud may only partially surround the compression device, or may be located farther away. It will also be appreciated that the shroud may be constructed to be removable after the jaws are compressed. A jaw alignment pin 61 is also attached to the bottom jaw 51, and is slideably received into top jaw 53 for assisting in keeping the jaws aligned. The bottom jaw 51 has an alignment surface 63 which assists in aligning the bottom material to be laminated. A spring 57 is used to separate the top and bottom jaws, thereby pressing the top jaw 53 against the hub 71. The top jaw 53 also has an alignment surface 69 for assisting the alignment of the top material. The top alignment surface 69 and the bottom alignment surface 63 cooperate to effectively and efficiently align the front edge of the materials to a common plane. An elongated stiffening member 65 is attached to the top jaw 53. The elongated stiffening member distributes a clamping force along an extended region of the edge of the materials, and enables fewer clamps to be used in a given distance.

The top jaw 53 also has an offset member 75 positioned between the top jaw 53 and the elongated stiffening member 65. The offset member 75 acts to offset the elongated stiffening member 65 by an offset angle. In this way, as the elongated stiffening member 65 is drawn towards the material, the front edge 67 of the elongated stiffening member 65 is first to contact the material. As additional compressive force is applied using handle 73, the give and play between the top jaw 53 and the bottom jaw 51 causes the back edge of the elongated stiffening member 65 to rotate towards the material, thereby providing a flatter surface to distribute the clamping force. It will be appreciated that the size of the offset member 75 will be set according to the tolerances and play allowed between the jaws. For example, if a larger hole is placed in top jaw 53 through which the bolt extends, additional play will exist between the top and bottom jaw. In this way, the offset member needs to be larger to accommodate for the additional movement during compression. However, if the hole through the top jaw tightly receives the bolt, then the offset member may be smaller as there will be less give as clamping force is applied. Give and play may also include the flexibility in the materials themselves. In one specific example, the offset member extends away from the top jaw approximately $1/16^{th}$ of an inch. It will be appreciated that other sizes may be used dependent upon application-specific requirements.

Figure 3:
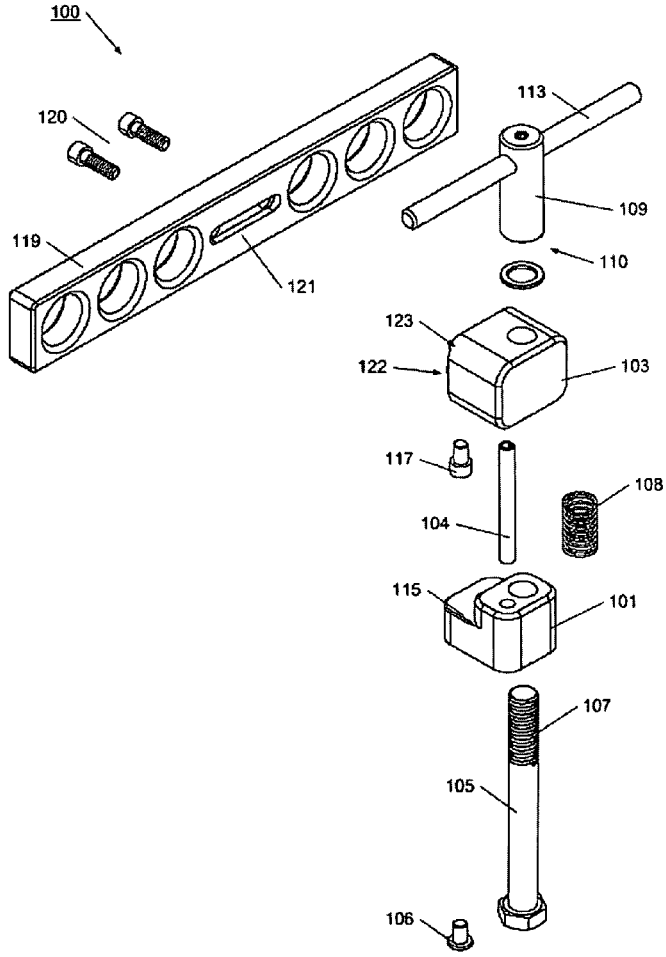
FIG. 3 is an exploded rear perspective view of a solid surface clamp in accordance with the present invention.

Referring now to FIG. 3, an exploded view of a solid surface clamp is illustrated. Solid surface clamp 100 has a bottom jaw 101 which has an alignment surface 115. A bolt 105 is inserted into bottom jaw 101, and is fixed into position by screw 106. A spring 108 is positioned around the bolt 105, and the threaded portion of the bolt extends through the top jaw 103. A hub 109 has integral threads 110 which thread on to the threaded portion of bolt 107. The spring 108 acts to press the top jaw 103 against the hub 109, which acts to separate the jaws. A jaw alignment pin 104 also attaches to the bottom jaw 101, and extends into a bore in top jaw 103. The jaw alignment pin 104 thereby acts to assist in keeping the top and bottom jaws aligned. The top jaw 103 also has an alignment surface 117. The alignment surface may be a threaded screw, which has a substantial head for resting against an edge of the material to be laminated. It will be appreciated that other alignment surfaces may be used. The top jaw 103 also has an offset member 123 for slightly rotating the elongated stiffening member 119 away from the top jaw 103.

The elongated stiffening member 119 is attached to the top jaw 103 using bolts 120. A protrusion 122 on the top jaw 103 mates with a cooperating void 121 on the elongated stiffening member to assist in properly aligning the elongated stiffening member. It will be appreciated that other alignment mechanisms may be used or that the top jaw be integrally formed into the elongated stiffening member eliminating the need for an alignment mechanism. A handle 113 is slideably inserted into hub 109. In one example, the hub 109 also is shaped to cooperate with a power driver. In this way a power driver inserted over hub 109. It will be appreciated that more or fewer parts may be used to construct the solid surface clamp. For example, the bolt and bottom jaw may be constructed as a single piece. In another example, the top jaw and the elongated stiffening member are integrally formed. It will also be appreciated that the elongated stiffening member may be made longer or shorter. In one example, the elongated stiffening member may only be slightly larger than or as large as the width of the top jaw itself.

Figure 4:
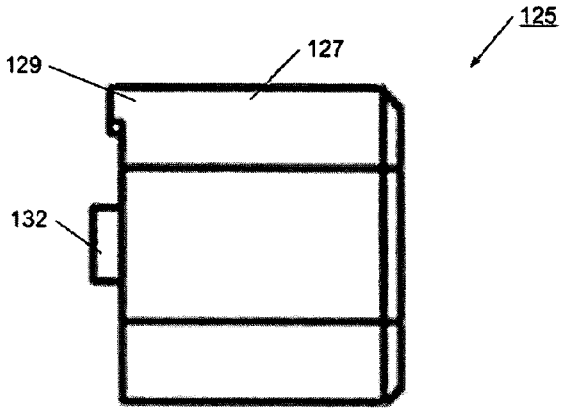
FIG. 4 is a side view of a top jaw of a solid surface clamp in accordance with the present invention.

Referring now to FIG. 4, an enlarged view of a top jaw 127 is illustrated. The top jaw 127 is shown with an offset member 129. As illustrated, the offset member 129 is integrally formed with the top jaw 127. It will be appreciated that the offset member 129 need not be integrally formed with the top jaw 127. A protrusion 132 is also provided for assisting in aligning an elongated stiffening member. The protrusion 132 cooperates with a mating void in the elongated stiffening member to assist in properly aligning the elongated stiffening member to the top jaw.

Figure 5:
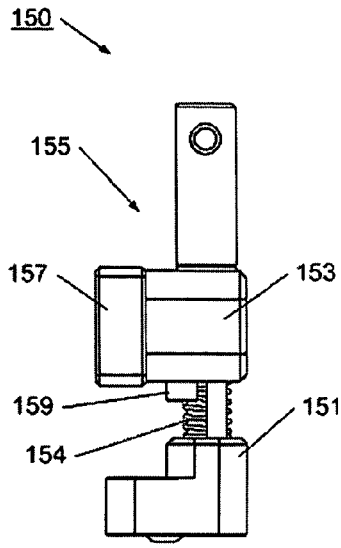
FIG. 5 is a side view of a solid surface clamp in accordance with the present invention.

Referring now to FIG. 5, another solid surface clamp is illustrated. Solid surface clamp 150 includes a bottom jaw 151 coupled with a connecting rod in the form of bolt 154 to top jaw 153. The top jaw 153 has a compressive device 155 in the form of a cooperating thread and nut to provide compressive force between the jaws. An elongated stiffening member 157 is attached to the top jaw 153. The top jaw 153 does not have an offset member, so the elongated stiffening member 157 is positioned generally parallel to the face of the top jaw 153. The top jaw 153 also has an alignment surface 159 to assist in aligning the material to be laminated.

Figure 6:
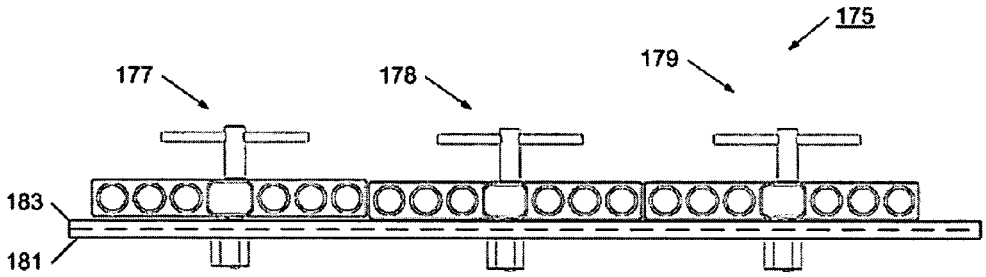
FIG. 6 is a plan view of a set of clamps in accordance with the present invention.
Figure 7:
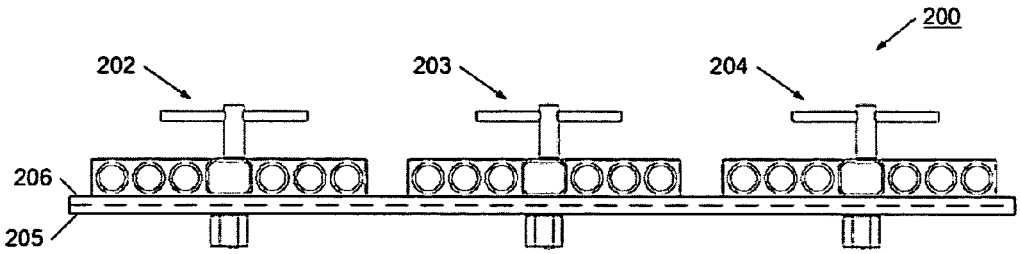
FIG. 7 is a is a plan view of a set of clamps in accordance with the present invention.

Referring now to FIG. 6, a clamping system 175 is illustrated. Clamping system 175 includes a set of clamps 177, 178, and 179. Each of these clamps is like clamp 10 described earlier with reference to FIG. 1. As illustrated, the clamps may be placed in an adjacent arrangement. Due to the length of the elongated stiffening member, the body of each clamp is spaced apart from the next clamp. In this way, material 183 may be securely clamped to material 181 during the lamination process. Even though the jaws of the clamps are spaced apart, the clamping force is evenly distributed across the top of material 183. It will also be appreciated that the clamps may be even further spaced apart. For example, FIG. 7 shows clamping system 200 with solid surface clamps 202, 203, and 204 separated by a space. Even though a space exists between the clamps, materials 205 and 206 are still sufficiently clamped for accurate and even lamination. It will be appreciated that an elongated stiffening member may also be attached to the lower jaw dependent upon application-specific requirements.

Figure 8:
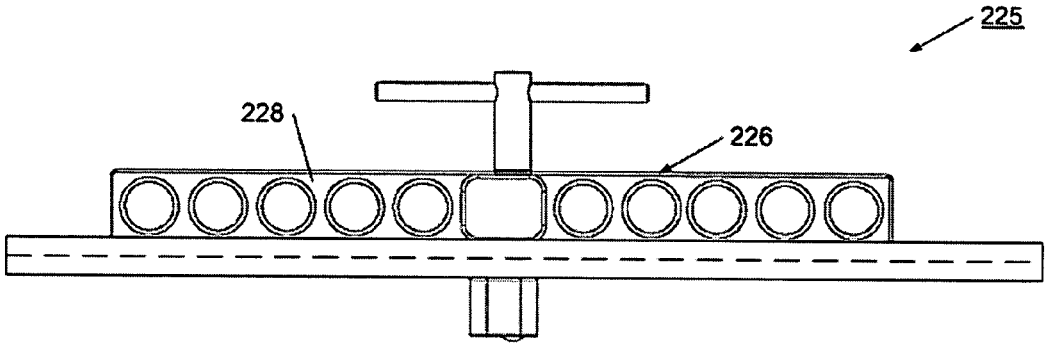
FIG. 8 is a is a plan view of a solid surface clamp in accordance with the present invention.
Figure 9:
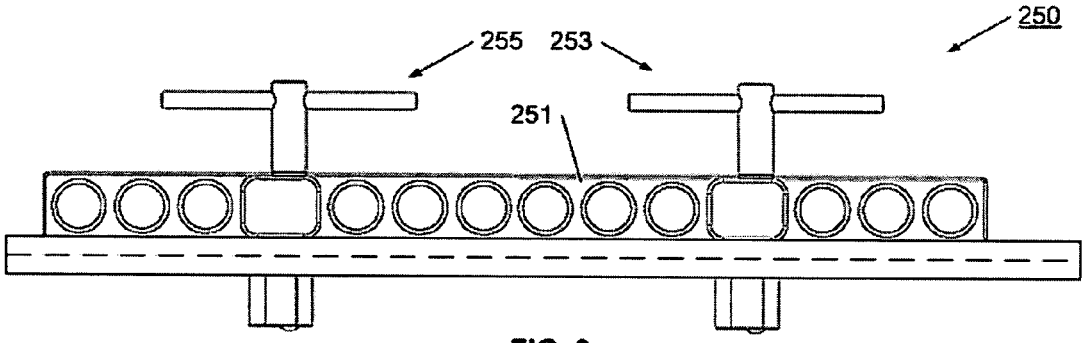
FIG. 9 is a is a is a plan view of a solid surface clamp in accordance with the present invention.
Figure 10:
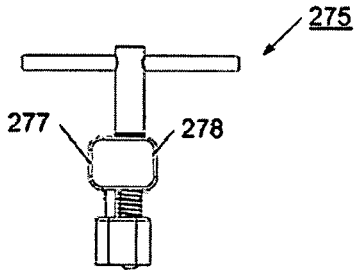
FIG. 10 is a plan view of a solid surface clamp in accordance with the present invention.

Referring now to FIG. 8, another solid surface clamp 225 is illustrated. Solid surface clamp 226 has a longer elongated stiffening member 228 as compared to elongated stiffening member of clamp 10. It will be appreciated that the length of the elongated stiffening member may be adjusted according to the needs of a specific work environment. For example, certain materials may require less clamping force, so a longer elongated stiffening member may be used. Also, the length of the elongated stiffening member may be selected according to the tolerances and strength of construction of the clamp. For example, a more substantial elongated stiffening member will be more rigid and enable a longer member. Also, as illustrated in FIG. 9, a solid surface clamp 250 may include multiple sets of jaws coupled to a single elongated stiffening member 251. The jaws may be fixedly attached to the elongated stiffening member. In another example, the jaws may slide in a track on the elongated stiffening member, and be held in place with set screws or other holding structures. In yet another example, the jaws may be integrally formed with the elongated stiffening member. As illustrated, clamp 250 has a first set of jaws 255 and a second set of jaws 253. It will be appreciated that more or fewer sets of jaws may be used according to application specific needs. For example, clamping of heavier materials may require the closer spacing of the sets of jaws, while some materials may allow the sets of jaws to be spaced further apart. Also, as shown in FIG. 10, a clamp 275 may have a very short elongated stiffening member, and may be integrally formed with the top jaw. Such a clamp may be useful for clamping in limited spaces, or may be required for certain types of materials. It will be appreciated that the length and thickness of the elongated stiffening member may be selected according to application specific needs.

Figure 11:
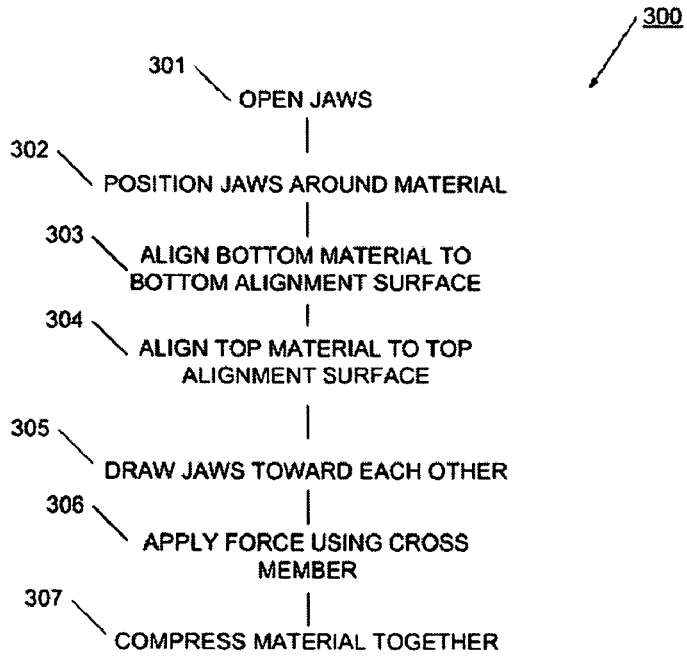
FIG. 11 is a flowchart of a process of clamping in accordance with the present invention.

Referring now to FIG. 11, a process for clamping material is illustrated. First, a set of jaws is opened as shown in block 301. The jaws are then positioned around the materials 302. A bottom alignment surface is used to align the bottom material as shown in block 303, while an alignment surface on the top jaw is used to align the top material surface as shown in block 304. Once the materials are properly aligned, the jaws are drawn together with a compressive device as shown in block 305. As the jaws are drawn together, an elongated stiffening member is used to apply a force along an elongated front edge of the material as shown in block 306. Sufficient force is applied to draw the material together to complete the laminating process as shown in block 307. After the adhering agent has cured, then the clamps may be removed.

Figure 12:
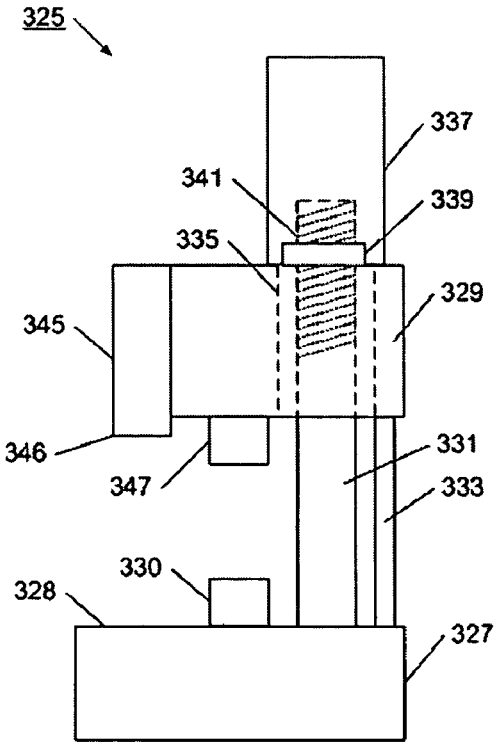
FIG. 12 is a block diagram of a solid surface clamp in accordance with the present invention.
Figure 13:
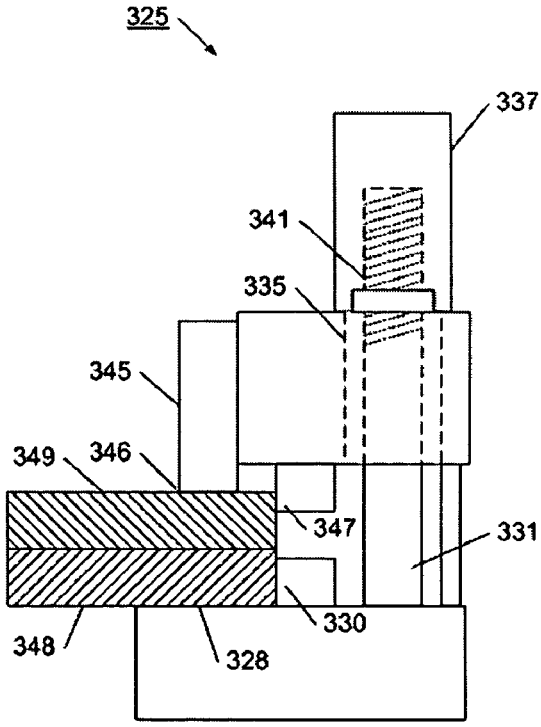
FIG. 13 is a block diagram of the solid surface clamp of FIG. 12 in a compressed arrangement.

Referring now to FIG. 12 and FIG. 13, a functional block diagram of a solid surface clamp is illustrated. FIG. 12 illustrates the clamp 325 in an open position, ready to receive material to be laminated, while FIG. 13 shows clamp 325 in a compressed position, with material 349 being laminated to material 348. Typically, the bottom material 348 will be a substantial slab of solid surface material, such as a countertop, while the top material 349 will be a narrow strip of the same or a complementary material. In this way, the top material is often considerably more fragile than the bottom material, and subject to break or fissure. Clamp 325 includes a bottom jaw 327 having a support surface 328 and an alignment surface 330 for positioning a lower piece of material 348 for lamination. A connecting rod 331 extends from bottom jaw 327 through top jaw 329. Hole 335 extends through top jaw 329 and allows a threaded portion 341 of the connecting rod 331 to extend through the upper jaw 329 and into hub 337. Hub 337 has a nut 339 for threadably receiving the threaded portion 341 of the bolt. The nut 339 may be integrally formed with hub 337. Together, the nut 339 and threads 341 cooperate to form a compression device. It will be appreciated that other compression devices may be used. Top jaw 329 has an elongated stiffening member 345 for applying compressive force across an extended region of the top material 349. The stiffening member 345 applies the compressive force evenly across the top material 349, and since the top material 349 may be a narrow strip, reduces breakage or fissuring of the top material. The length of the elongated stiffening member 345 also enables the clamps to be positioned in a spaced-apart arrangement. The elongated stiffening member 345 has a bottom surface 346 which is compressed against the top material 349 during the lamination process. An alignment surface 347 is also attached to the top jaw 329 to assist in properly aligning the top material to the bottom material.

In use, an epoxy, adhesive, or other adhering agent is dispensed on the surfaces of the pieces that are to be laminated together. Typically, the bottom piece will be a larger slab of material, while the top piece is a relatively narrow strip of material. For example, when laminating a granite slab, the granite slab is used as the bottom piece, while an 1½ inch wide strip of granite is used as the top piece. When cured, the slab is turned over so that the strip becomes a lower edge to a countertop. The bottom piece is positioned onto support surface 353 and against alignment surface 351. A top piece of material is also aligned against alignment surface 347. In this way, the front edges of the two pieces of material are positioned in a flush or common plane arrangement. The hub 337 is rotated, either manually by handle or knob, or by using a power tool, to rotate the nut 339 further onto the threaded portion 341. As the nut is drawn onto the threaded portion 341, the top jaw 329 and the bottom jaw 327 are drawn together. The spring 333 which normally acts to keep the jaws spaced apart, is further compressed. When the hub 337 is torqued to the proper amount, the pieces of material 349/348 are compressed between the elongated stiffening member surface 346 and the lower jaw surface 328. In this way, sufficient compressive force is evenly distributed on the pieces to provide for an even and proper lamination.

Figure 14:
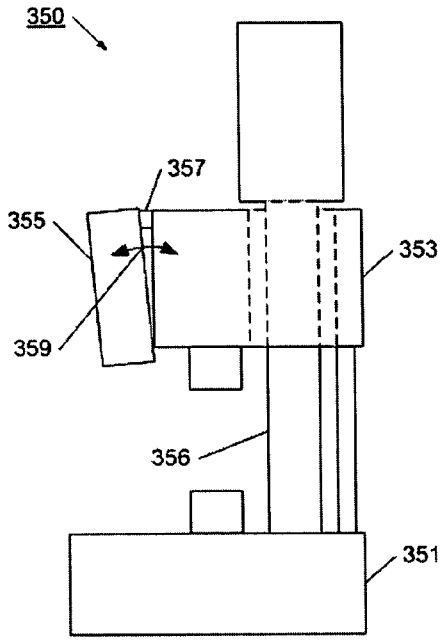
FIG. 14 is a block diagram of a solid surface clamp in accordance with the present invention.

Referring now to FIG. 14, another solid surface clamp 350 is illustrated. Solid surface clamp 350 also has a bottom jaw 351 connected with a connecting rod 356 to a top jaw 353. The top jaw 353 has an elongated stiffening member 355. The top jaw 353 also has an offset member 357 which rotates the elongated stiffening member from the top jaw 353 by an offset angle 359. This small offset angle 359 is selected according to the amount of give and play present in the solid surface clamp. Accordingly, when the elongated stiffening member is brought under proper compression, it is rotated back to a more parallel position in relation to the material.

Figure 15:
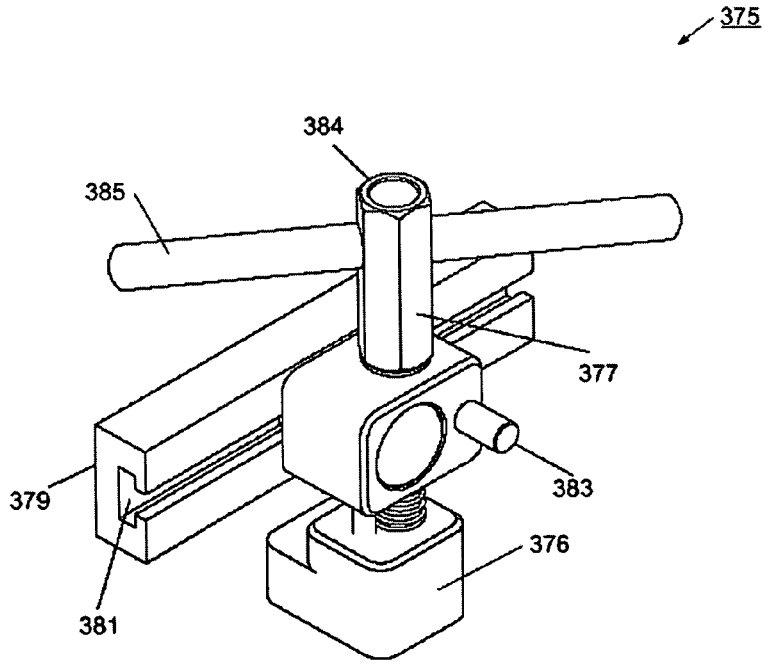
FIG. 15 is a rear perspective view of a solid surface clamp in accordance with the present invention.

Referring to FIG. 15, the elongated stiffening member 379 has an integrated slide mount track 381. The elongated stiffening member 379 allows the individual clamping devices to be spaced far apart and still have even clamping pressure (force distribution). The individual clamping devices can be positioned where needed by the user over the entire length of the elongated stiffening member 379 due to the integrated slide mount track 381. To do this, the user loosens the screw 383, slides the individual clamping device to the desired location along the slide mount track 381, and then tightens the screw 383 to secure the individual clamping device in place. The screw threads on the individual clamping devices are covered or "non-exposed" as the location of the screw threads are inside the handle hub 384, thus protecting them from adhering agent contamination and binding from cured adhering agents. Due to its shape, the handle hub 384 allows a user to operate the individual clamping devices manually "by hand", by using handle 385, or by assistance of tools such as an air-powered ratchet wrench or an adjustable torque wrench.

Figure 16:
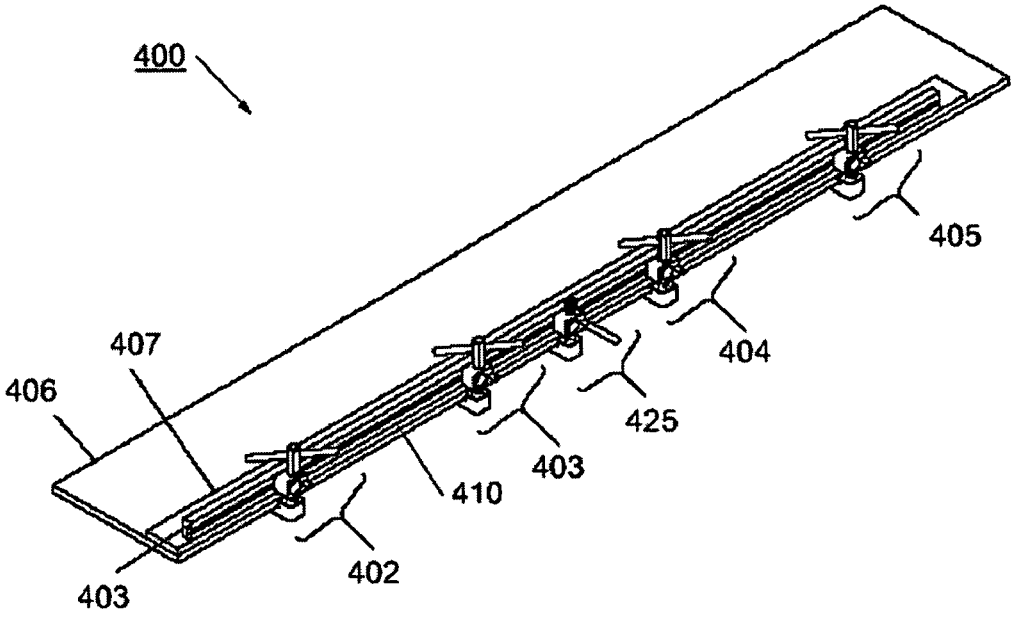
FIG. 16 is a rear perspective view of a set of clamps in accordance with the present invention.
Figure 17:
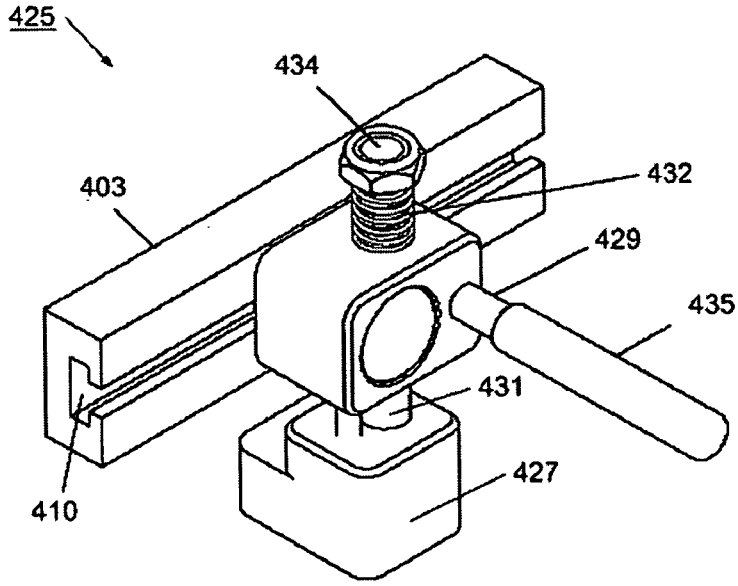
FIG. 17 is a rear perspective view of a holding clamp in accordance with the present invention.

Referring to FIG. 16 and FIG. 17, bottom material 406 is joined to top material 407 with a clamp consisting of some individual clamping devices 402, 403, 404, and 405, a holding clamp 425, and an elongated stiffening member 403, while the adhering agent cures. Because the individual clamping devices 402-5 have alignment surfaces, the material 406 and material 407 can be aligned prior to tightening the individual clamping devices 402-5. This allows the efficient alignment of the material so that the front edges of the two materials are flush with each other across the front edge.

The elongated stiffening member 403 has an integrated slide mount track 410. The elongated stiffening member 403 allows the holding clamp 425 to be placed where it is most convenient for the user (typically near the center of mass of the clamp). To do this, the user loosens the screw 429, slides the holding clamp to the desired location along the slide mount track 410, and then tightens the screw 429 to secure the holding clamp in place. A handle 435 is integrated into the screw 429 by which the user can hold the holding clamp. It will be appreciated that the handle 435 need not be integrally formed with the screw 429. The holding clamp is quick acting clamp device used to hold in place the material to be laminated, while the user operates the other individual clamping devices 402-5. To operate the holding clamp, the user presses down on the spring loaded connecting shaft 434 while holding handle 435, slides the holding clamp 425 against the material to be laminated, and then releases spring loaded connecting shaft 434. The material is then held loosely in place only by the holding clamp, unassisted by a user or other individual clamps. This enables the user to more easily attach and secure the clamps 402-5.

The solid surface laminating clamp system reduces the time it takes to join materials in the process of lamination. The reduction of time is partially due to the substantial reduction in the number of clamps needed per linear foot, and is accomplished by an elongated stiffening member between each "spaced-out" individual clamping device. In one example, the number of clamps may be reduced by about 75 to 85%. The elongated stiffening member takes the place of intermediate clamps and also distributes the pressure of the individual clamps to the areas that have no clamps. The present invention also allows for the use of power tools to operate the individual clamping devices, further contributing to the reduction of time it takes to join materials. The general ease of use and other features such as the holding clamp, the slide mount track, and the alignment surfaces on the individual clamping devices are all designed to contribute to the reduction of the time it takes to join materials.

Long term cost savings are achieved by not having to replace the individual clamping devices as often, due to the screw threads on the individual clamping devices are not exposed to contamination by the strong adhering agents used in the process of lamination. In contrast, c-clamps often bind up and are rendered unusable due to adhering agents that cure on the exposed screw threads. The life span of a c-clamp is, in most cases, only two to three months. Consequently, even though a single c-clamp is relatively inexpensive, due to their short life span and the fact that so many are needed, solid surface fabrication companies end up spending hundreds to thousands of dollars a year replacing them, depending on the amount of production the company does.

Quality control rejections due to uneven clamping pressures are reduced. The solid surface clamp can dramatically reduce user fatigue which is a major contributor to uneven clamping pressures and, ultimately, poor material lamination. This reduction in user fatigue is again due to the reduced number of clamps needed per linear foot, and also because the present invention allows for the use of power tools. In addition, very even clamping pressures can be achieved through the use of an adjustable torque wrench on the individual clamping devices.

With the solid surface clamp, the risk of a repetitive motion injury such as carpal tunnel syndrome is greatly reduced by eliminating the need to tighten so many c-clamps. Not only are there fewer individual clamps to operate, the present invention also allows for the use of power tools further reducing the risk of repetitive motion injury. This is a real concern for solid surface fabrication companies who already pay a premium in workers compensation insurance fees.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed is:

1. A solid surface clamp, comprising:

a top jaw constructed to exert a clamping force on an elongated stiffening member;

a bottom jaw having a first surface configured to contact a solid surface slab;

a bolt attached to the bottom jaw and slideably received through the top jaw, a threaded portion of the bolt extending from the top jaw;

a nut threaded onto the threaded portion of the bolt, the nut and threaded portion constructed to transition the solid surface clamp from a fully open position to a clamping position;

a shroud shielding the nut and the entire threaded portion of the bolt that extends from the top jaw, the shroud constructed to continuously shield the nut and the entire threaded portion that extends from the top jaw i) when the solid surface clamp is the fully open position; in when the solid surface clamp transitions from the fully open position to the clamping position; and iii) when the solid surface clamp is in the clamping position;

the elongated stiffening member attached to the top jaw and having a second surface configured to contact the solid surface slab;

wherein the second surface is longer than the first surface and both surfaces are substantially parallel to each other.

2. The solid surface clamp according to claim 1, wherein the nut is integrally formed in the shroud.

3. The solid surface clamp according to claim 1, further including a protrusion and a mating void arranged to align the top jaw to the elongated stiffening member.

4. The solid surface clamp according to claim 1, further including an offset member attached to a face of the top jaw and positioned to offset the elongated stiffening member at an offset angle.

5. The solid surface clamp according to claim 1, further including a spring extending between the top jaw and the bottom jaw.

6. The solid surface clamp according to claim 5, wherein the spring is positioned around the bolt.

7. The solid surface clamp according to claim 1, further including an alignment surface coupled to one of the jaws.

8. The solid surface clamp according to claim 7, further including another alignment surface coupled to the other one of the jaws.

9. The solid surface clamp according to claim 1, wherein the first surface is about 1½ inches in length, and the second surface is about one foot in length.

10. The solid surface clamp according to claim 1, wherein the second surface is more than 4 times the length of the first surface.

11. The solid surface clamp according to claim 1, further including a jaw alignment pin adapted to align the top jaw with the bottom jaw.

12. The solid surface clamp according to claim 1, wherein the elongated stiffening member is adjustably attached to the top jaw which allows the elongated stiffening member to slide with respect to the top jaw.

* * * * *